United States Patent [19]

Oldshue

[11] 3,966,542

[45] June 29, 1976

[54] MULTI-STAGE BLEACHING OF PULP USING SUCCESSIVELY LOWER POWER LEVELS

[75] Inventor: James Y. Oldshue, Rochester, N.Y.

[73] Assignee: General Signal Corporation, Rochester, N.Y.

[22] Filed: Sept. 20, 1974

[21] Appl. No.: 507,892

[52] U.S. Cl. ..... 162/57; 68/181 R; 162/57; 162/88; 162/241; 162/243; 259/6; 259/8

[51] Int. Cl.[2] ..... D21C 3/26; D21C 9/12

[58] Field of Search ..... 162/57, 59, 88, 243, 162/19, 149, 17, 241, 65; 259/6, 7, 8; 68/181 R; 23/283

[56] References Cited

UNITED STATES PATENTS

| | | | |
|---|---|---|---|
| 66, 353 | 7/1867 | Joy et al. | 162/59 |
| 1,792,059 | 2/1931 | Altwegg | 259/7 |
| 1,827,710 | 10/1931 | Leyst-Küchenmeister | 162/57 X |
| 2,431,478 | 11/1947 | Hill | 162/57 X |
| 2,516,447 | 7/1950 | Burling et al. | 162/57 |
| 2,730,426 | 1/1956 | Becker | 23/283 X |
| 3,660,225 | 5/1972 | Verreyne et al. | 162/17 |
| 3,725,193 | 4/1973 | Montigny et al. | 162/17 |
| 3,754,417 | 8/1973 | Jamieson | 68/181 R |

*Primary Examiner*—Robert L. Lindsay, Jr.
*Assistant Examiner*—M. Steven Alvo
*Attorney, Agent, or Firm*—Harold Huberfeld; Jeffrey S. Mednick

[57] ABSTRACT

A process for bleaching pulp in tank comprises several steps. A pulp slurry and an oxidizing agent are supplied to a first tank compartment. The mixture of pulp slurry and oxidizing agent is agitated at a first power level that corresponds to an approximate minimum power level for a maximum reaction rate on a plot of reaction rate versus power level for a first residence time. The mixture is re-agitated in another tank compartment at a second power level that corresponds to an approximate minimum power level for a maximum reaction rate on a plot of reaction rate versus power level for a second residence time. The second power level is lower than said first power level and corresponds to the amount of unreacted oxidizing agent and unreacted pulp slurry.

9 Claims, 3 Drawing Figures

MULTI-STAGE BLEACHING OF PULP USING SUCCESSIVELY LOWER POWER LEVELS

BACKGROUND OF THE INVENTION

While the invention is subject to a wide range of applications, it is especially suited for use in a pulp bleaching system and will be particularly described in that connection. In making paper, pulp (primarily cellulose fibers and lignin) is processed to separate the cellulose fibers from the lignin which are the primary constituent in the paper. The lignin, a binder for the fibers, is generally of a darker color. In order to produce white paper, it is necessary to remove the lignin from the pulp. To accomplish this, an oxidizing agent, such as chlorine, is added to a pulp slurry. The lignin is oxidized and becomes soluble for easy removal from the pulp.

In the past, a standard practice was to mix a pulp slurry with chlorine in a chlorinator and deliver the resulting mixture to a chlorination tower for allowing the reaction to be completed. The chlorinator serves to both mix the chlorine with the pulp slurry and to allow the reaction to begin before the mixture enters the chlorination tower. This step is important because wet chlorine gas from the mixture might otherwise rise directly up the tower in a phenomenon called channeling. Wet chlorine gas, being very corrosive, requires equipment of a special alloy and careful use to avoid serious maintenance problems of the equipment. Further, when channeling occurs in a chlorination tower, the concentration of chlorine in the pulp slurry decreases and causes a longer time to complete the reaction. Also the chlorine bubbling through the tower carries pulp and uneven bleaching occurs. Further, the loss of this chlorine causes a greater expense in operating the apparatus.

The early chlorinators consisted of static mixers. These are essentially pipes with internal baffles to create turbulence between the chlorine and the pulp slurry and thereby provide mixing. This type of mixer has several disadvantages. First, the gas, frequently incompletely mixed with the pulp slurry, causes corrosion as well as the channeling in the chlorination tower. Secondly, when the chlorine is not evenly mixed with the pulp slurry, the brightness of the resulting paper is not even. Further, a longer reaction time is required to complete the oxidation of the lignin. Finally, a higher chlorine concentration is required to establish the proper brightness of the paper, and therefore, more chlorine is required.

The next stage in development of chlorinators included the use of a single stage completely mixed system. This consists of a tank with an agitator that completely mixes the pulp slurry and chlorine before it is delivered to the chlorination tower. To a large extent, this system solves the problem of uneven distribution of the chlorine. It also blends out any fluctuations between the concentration of the pulp and the chlorine. Although the concentration of chlorine can be carefully controlled, the amount of fiber being introduced into the system varies since the consistency of the pulp slurry fluctuates. The single stage system does introduce a problem of under and over bleaching of fibers. This is due to the variation in the residence time of the fibers in the system. Since a fiber entering the system may go directly out of the system, there is a probability that certain fibers are under bleached. On the other hand, fibers may remain in the system for a very long period and are thereby over bleached.

The next improvement came with the introduction of chlorinators being multi-stage systems. Here the chlorine and pulp are mixed in a first stage and then passed into at least one additional stage wherein the mixture is agitated and finally passed into a chlorination tower. The multi-stage systems are able to solve the retention problems and thereby inhibit under and over bleaching of the fibers. Just as there is given probability that a fiber could pass through a single stage in a very short period of time, there is an equal probability that the same fiber may take an extremely long period of time to pass through a second stage. Therefore, by increasing the number of stages through which the fiber must pass, the probability of a proper retention time increases. Another advantage of the multi-stage system is that by mixing the mixture in several stages, there is less chance for wet chlorine to pass into the tower.

Another distinct advantage of the multi-stage system is related to the reaction between chlorine and the pump being a first order reaction. If the concentration of the chlorine in the mixture decreases by 50 percent, the total reaction time increases by approximately 50 percent. In the multi-stage system, each stage has a decreasing concentration of chlorine because the chlorine is continually being used up in oxidizing the lignin. This results in the reaction proceeding at a faster rate in the earlier stages, as compared to a single stage system, since these earlier stages have a higher concentration than is found in a completely mixed single stage system.

One of the advantages of increasing the reaction rate is that the chlorination tower need not be quite as large to permit the reaction to be completed. It has also been found that agitating the solution increases the reaction rate and decreases the amount of chlorine required for bleaching. Thus, by increasing the number of stages, mixing increases, the reaction rate increases, and the amount of chlorine required decreases.

It is an object of the present invention to reduce the total reaction time between chlorine and pulp.

It is a further object of the present invention to reduce the amount of chlorine required in the reaction between chlorine and pulp.

It is a further object of the present invention to change the power level between the stages of a multi-stage chlorinator.

It is a further object of the present invention to reduce the size of the equipment used in the oxidation of pulp.

It is a further object of the present invention to reduce the power consumed in oxidizing pulp.

SUMMARY OF THE INVENTION

In accordance with the present invention, a process for bleaching pulp in a tank comprises several steps. A pulp slurry and an oxidizing agent are supplied to a first tank compartment. The mixture of pulp slurry and oxidizing agent is agitated at a first power level that corresponds to an approximate minimum power level for a maximum reaction rate on a plot of reaction rate versus power level for a first residence time. The mixture is re-agitated in another tank compartment at a second power level that corresponds to an approximate minimum power level for a minimum reaction rate on a plot of reaction rate versus power level for a second residence time.

To be more specific, the process has a first power level which is higher than the second power level. The second power level may be reduced by increasing the volume of the other tank compartment or by decreasing the horsepower of the mixer which re-agitates the solution, or by both.

Also in accordance with the present invention, a mixing apparatus is provided for bleaching pulp in at least one tank. It includes apparatus for supplying a pulp slurry and an oxidizing agent to a first tank compartment. An agitating apparatus for agitating a mixture of said pulp slurry and oxidizing agent in said first tank compartment at a first power level that corresponds to an approximate minimum power level for a maximum reaction rate on a plot of reaction rate versus power level for a first residence time. Re-agitating means for re-agitating said mixture in another tank compartment at a second power level that corresponds to an approximate minimum power level for a maximum reaction rate on a plot of reaction rate versus power level for a second residence time.

For a better understanding of the present invention, together with other and further objects thereof, reference is made to the following description, taken in connection with the accompanying drawings, while its scope will be pointed out in the appended claims.

DESCRIPTION OF THE PREFERRED EMBODIMENT

Figure 1:
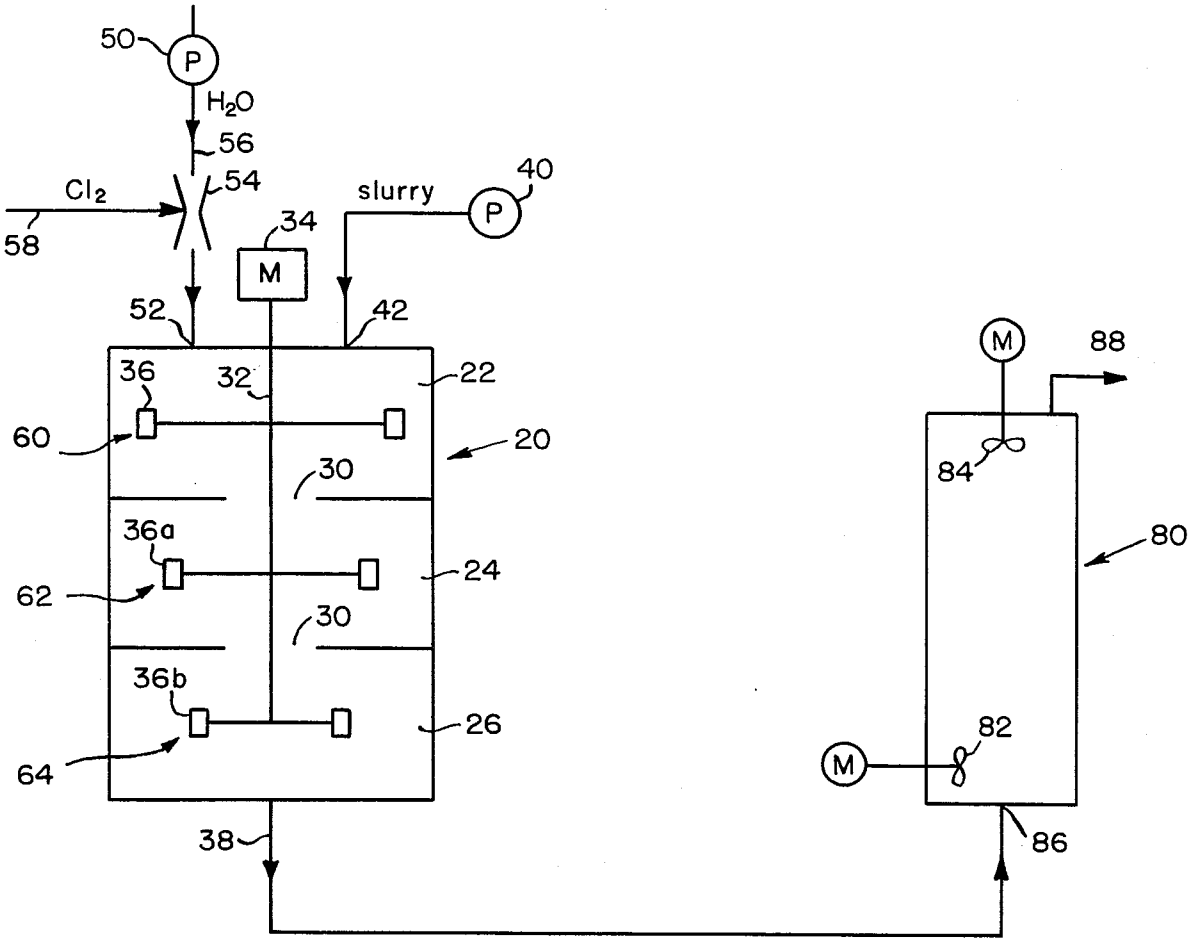
FIG. 1 is a schematic view of the present invention, illustrating a chlorinator and a chlorination tower.

In accordance with the present invention, a mixing apparatus for bleaching pulp in a chlorinator 20 includes a suitable pump 40, preferably centrifugal, for supplying a pulp slurry to a first compartment 22 in chlorinator 20. A suitable pump 50 preferably centrifugal, supplies a solution, including an oxidizing agent, to the first tank compartment 22. Mixer 60 agitates the mixture of pulp slurry and oxidizing agent at a first power level in the first tank compartment 22. Secondary mixer 62 re-agitates the solution at a second power level in second compartment 24. As will be described hereinbelow, additional tank compartments, such as compartment 26 in FIG. 1, may be provided to further re-agitate the solution.

Referring to FIG. 1, there is shown the first embodiment of a mixing system in accordance with the present invention. The system includes pump 40 for supplying slurry through an inlet 42 into first compartment 22 of tank 20. Pump 50 supplies an oxidizing agent through an inlet 52 in the first compartment 22. The oxidizing agent is preferably chlorine, but may consist of chemicals such as oxygen, ozone, or chlorine dioxide. The chlorine may be metered by any suitable device, such as, for example, a venturi 54. Water flows into the venturi through line 56 and draws chlorine through line 58 into the venture 54 and through inlet 52. This adds a predetermined amount of chlorine to the system at a desired rate, based on the flow of water. Although the slurry inlet 42 and the oxidizing agent inlet 52 have been illustrated as distinct inlets, it should be understood that the oxidizing agent may be combined with the slurry prior to the entrance into the first tank compartment 22.

While chlorinator 20 has been illustrated with three compartments, one skilled in the art will appreciate that the number of compartments is a function of the requirements of the system. The compartments are connected with each other through openings 30, each of which is designed in size to permit a desired amount of mixture to pass from one compartment to another compartment in a given time. A shaft 32 is supported by suitable bearings (not shown) in tank 20 and rotated by a suitable motor 34 which may have a speed reducer. In each of the compartments 22, 24, and 26, impellers **36, 36*a*, and 36*b* of mixers 60, 62, and 64, respectively, are rigidly mounted on shaft 32** by any suitable means to rotate with the shaft. These impellers may be of any desired style such as, for example, flat blade turbines, axial flow turbines, or propellers. The impellers may be constructed of any suitable corrosion resistant material such as stainless steel or plastic covered steel.

As will be described more fully below, the size and style of the impellers may vary from one tank compartment to another tank compartment to change the power levels in the various compartments. For example, impellers **36*a* in tank compartment 24 may be smaller than impellers 36 in tank compartment 22. Similarly, impellers 36*b* in tank compartment 24 may be smaller than impellers 36*a* in tank compartment 36*a*. It should also be understood that, under certain circumstances, some of the compartments may have impellers of the same size while other compartments have impellers of a different size. For example, impellers 36*a* and 36*b* in compartments 24 and 26 may be of the same size, but somewhat smaller than impeller 36 in compartment 22**. It is within the scope of the present invention to provide impellers of any desired size. Further, although a top entering impeller system has been illustrated, side entering impellers may be used in each or any one of the compartments, as desired.

Chlorinator 20 may be constructed of any suitable corrosion resistant material. An example of such a material is fiberglass-reinforced steel. Chlorinator 20 includes an outlet 38 which may lead from the final tank compartment 26 to a chlorination tower 80, if additional reaction time is necessary. The chlorination tower may be constructed of any suitable material, such as, for example, concrete walls lined with ceramic tile. It may include agitators 82 and 84 at the top and bottom, respectively, to control the flow of the mixture from inlet 86 to outlet 88.

In order to more fully understand the present invention, the procedure for determining optimum power levels must be considered. As used in this disclosure, "power level" may be defined as power per unit of volume, such as horsepower per 1,000 gallons. It is used in specifying the degree of agitation to be provided by a mixer to a solution in a container.

In accordance with the present invention, the first step is to determine the amount of chlorine necessary to oxidize the pulp slurry to be bleached so that no chlorine remains after the bleaching process. The information is generally based on trial and error, and experience, and a further elaboration is unnecessary to one skilled in the art. After the amount of chlorine is determined, it is combined with the pulp slurry and agitated at a given power level while the residual chlorine in the solution is measured at periodic intervals.

Figure 2:
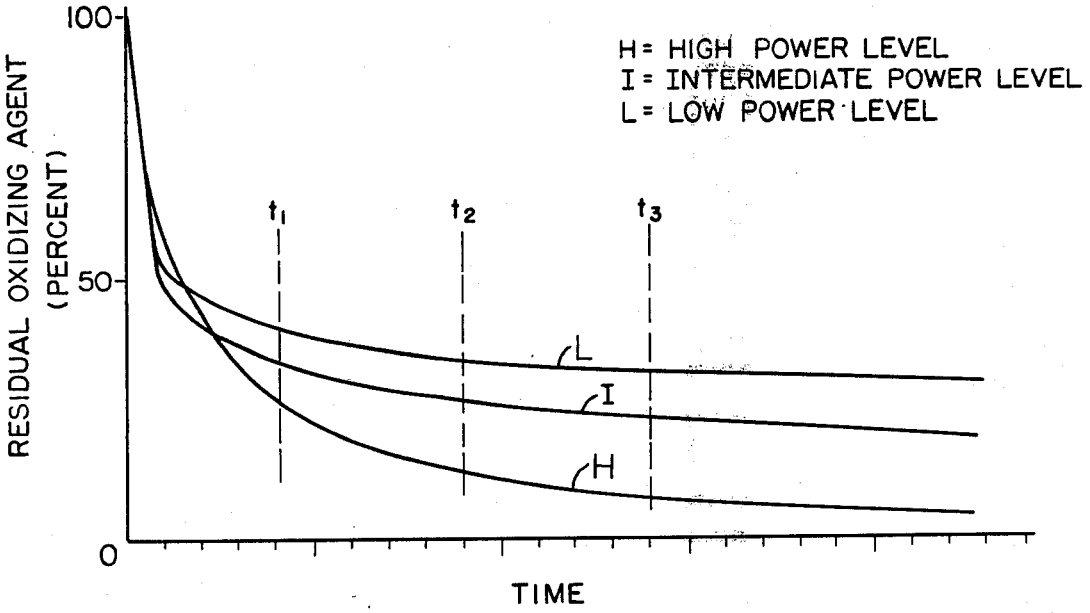
FIG. 2 is a graph illustrating residual oxidizing agent versus time for various power levels.

These measurements are accomplished by drawing samples of the mixture from the tank and adding them to potassium iodine acetic acid solutions. The contents of the solutions are then titrated with thiosulfate. Once the amounts of residual chlorine are known for the given power level, the percentage of residual chlorine with respect to the solution may be easily calculated and plotted on a curve, such as the one shown in FIG. 2. Note that FIG. 2 shows three such plots, but it should be understood that more (or less) plots may be made. As will be seen below, however, as the number of plots increases, so does the accuracy of the choice of optimum power levels.

Figure 3:
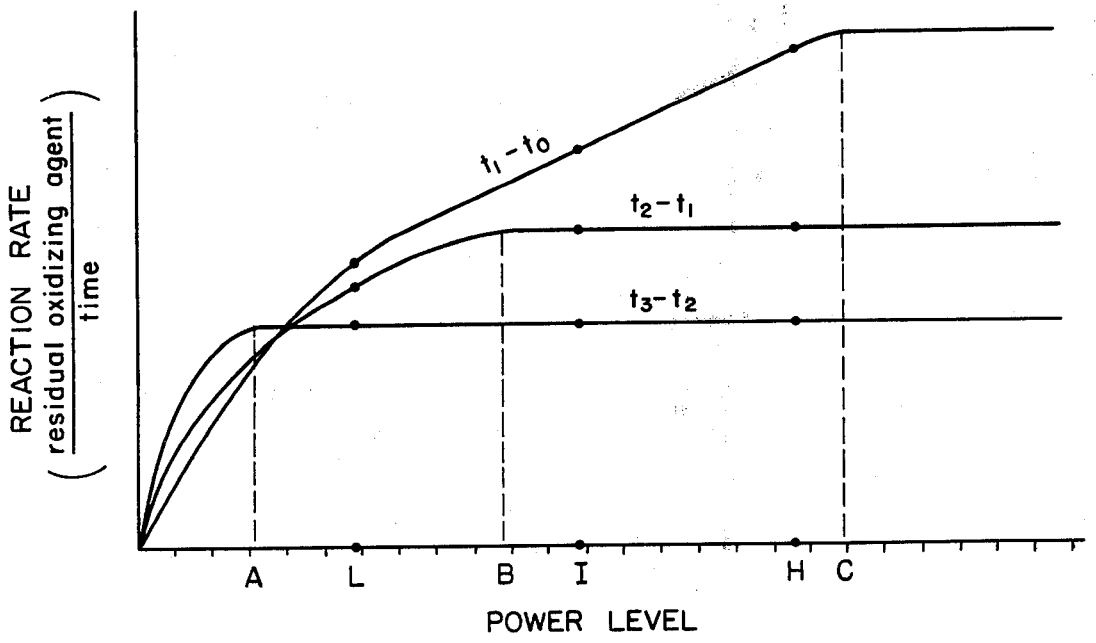
FIG. 3 is a graph illustrating reaction rate versus power level for various residence times.

Once the curves are developed such as H (high pressure level), I (intermediate power level) and L (low power level) in FIG. 2, it is possible to plot reaction rate of the oxidizing agent and pulp slurry versus power level for various time periods, as seen in FIG. 3. For each power level tested, a series of points may be plotted corresponding to the reaction rate during a particular time interval. As the number of plotted points increases, the shape of the curve becomes more accurate. Then a curve may be drawn between each point corresponding to the same time interval. Referring to FIG. 3, these curves are labeled $t_1 - t_0$, $t_2 - t_1$, and $t_3 - t_2$. A visual inspection of FIG. 3 will show that the reaction rate for each time interval (such as $t_1 - t_0$) increases up to a certain power level and the reaction rate then stays relatively constant. At the point where the rate begins to be relatively constant, the approximate maximum reaction rate is reached, and by projecting this point down to the power level axis, the power level to produce maximum reaction rate may be derived. Increasing the power level beyond this point is a waste of energy.

If one wished to design a chlorination system in accordance with the present invention, he could plot curves, such as the ones shown in FIGS. 2 and 3, based on the requirements of his system. It is well known that a system with many stages will have a higher average reaction rate (lower residence time) than a system with fewer stages. However, because of the economics involved, the number of stages should be kept to a reasonable amount.

Referring again to FIG. 3, there is shown a hypothetical plot of reaction rate versus power level. The plot shows three curves and is the type of plot that one would use in designing a three stage system. The residence time in each system is somewhat flexible, but it should be kept in mind that it is desirable to keep the overall residence time to a minimum. Therefore, it is also desirable to operate at the maximum reaction rate. The residence time for each change is a matter of experimentation, but for purposes of discussion, let us assume that the residence time in the second stage is to be $t_1 - t_0$; the residence time in the second stage is to be $t_2 - t_1$; and the residence time in the third stage is $t_3 - t_2$. It becomes clear from FIG. 3 that stage one should be operated at a power level C; stage two should be operated at a power level B; and stage three should be operated at a power level A. In other words, the agitator is operated at a power level that corresponds to the approximate minimum power level for a maximum reaction rate on a plot of reaction rate versus power level for a given residence time. In some cases, due to economic considerations such as the high cost of electricity, it may be desirable to operate at lower power levels, even though higher reaction rates are sacrificed. One skilled in the art will realize, therefore, that it is not always practical to operate at the precise power level that yields the maximum reaction rate. Therefore, when this disclosure refers to "approximate minimum power level for the maximum reaction rate," it should be understood that this refers to the optimum power level with economic considerations included.

The advantage of using the optimum power level in each stage of the chlorinator is that the reaction is driven to its completion in the shortest possible time. The reaction proceeds fastest in the stages having both the highest concentration of chlorine and the highest concentration of unoxidized pulp. Therefore, it is desirable to attempt to accomplish the maximum amount of oxidation in these stages. In this way the reaction can be completed more quickly than when the mixture is at a lower concentration. To minimize the residence time of the mixture in the chlorinator, one must keep in mind that the reaction rates in the various stages differ, since the concentration of chlorine and unoxidized pulp decreases as the mixture passes through the chlorinator. Therefore, more bleaching will occur in one minute of reaction time in the first stage than will occur in one minute of reaction time in the second stage. This would lead one to believe that substantially all of the bleaching process should be performed in the first stage. However, if this were to be done, the concentration of both chlorine and unoxidized pulp in this first stage would decrease and so would the reaction rate.

In designing a multi-staged chlorinator in accordance with the present invention, many factors are taken into account. Some of these considerations include the number of stages, the size of the tank, the power level for each stage, the residence time for each stage, the entrance point of the mixers (top entering or side entering), and the need of a chlorination tower. The decision as to the type and size of equipment is largely based on economical considerations. For instance, if a chlorination tower is already available, the chlorinator may be sized to allow some of the reaction to take place in the tower. On the other hand, if there is no existing chlorination tower, the chlorinator may be sized to permit the entire reaction to be completed within the chlorinator and thereby eliminate the expense of building a chlorination tower.

There are many ways of fixing the power levels of the stages. Remembering that power level is power per volume of liquid, it can be varied by varying the volume of a tank compartment, selecting a particular style impeller, varying the diameter of the impeller, and changing the speed of rotation of an impeller. Any one or combination of these variables may be altered to change the power level.

In order to more fully understand the present invention, consider the following example: A typical six stage chlorinator, approximately 8 feet in diameter by 16 feet high, may be operated at the power levels and for the residence times indicated in the following chart:

| Stage | Power Level (HP/100 gallons) | Residence Time (seconds) |
|---|---|---|
| 1 | 60 | 30 |
| 2 | 50 | 40 |
| 3 | 30 | 50 |
| 4 | 20 | 60 |
| 5 | 20 | 60 |
| 6 | 20 | 60 |

To obtain these power levels, a three blade propeller, approximately 37 inches in diameter, may be mounted on shafts to form portions of side entering mixers. The shafts may be rotated at approximately 400, 370, 350, 350, 350, and 350 revolutions per minute, respectively, by 75, 60, 50, 50, 50, and 50 horsepower motors, respectively. A solution of approximately 2 grams of chlorine per liter may be added to the first compartment with a pulp slurry containing approximately 3.5 percent pulp by weight. A chlorination tower approximately 12 feet in diameter by 30 feet high may be used to further oxidize the pulp slurry. If the chlorination tower is to be omitted, approximately ten additional stages may be added to the chlorinator. Each additional stage should have a power level of approximately 0.5 horsepower per thousand gallons and a residence time of approximately one minute. The residence time in the 16 stage chlorinator is, therefore, approximately 15 minutes. This compares favorably to the prior art combination of a multi-stage chlorinator and a chlorination tower which would have a retention time of approximately thirty minutes under similar conditions.

One skilled in the art will realize there has been disclosed a system for reducing the total reaction time between chlorine and pulp, reducing the amount of chlorine required in the reaction between chlorine and pulp, changing the power levels between the stages of a multi-stage chlorinator, reducing the size of the equipment used in the oxidation of pulp, and reducing the power consumed in oxidizing pulp.

While there has been described what is at present considered a preferred embodiment of the invention, it will be obvious to those skilled in the art that changes and modifications may be made therein without departing from the invention, and it is, therefore, aimed in the appended claims to cover all such changes and modifications as followed in the true spirit and scope of the invention.

I claim:

1. A process for bleaching pulp in a tank comprising the steps of:

a. supplying a pulp slurry to a first tank compartment;
b. supplying an oxidizing agent to said first tank compartment;
c. agitating a mixture of said pulp slurry and oxidizing agent in said first tank compartment at a first power level;
d. supplying said mixture to another tank compartment; and
e. re-agitating said mixture in said another tank compartment at a second power level that is lower than said first power level and corresponds to the amount of unreacted oxidizing agent and unreacted pulp slurry.

2. The process defined in claim 1, wherein said second power level is reduced by decreasing the horsepower of a mixer which re-agitates said mixture.

3. The process defined in claim 2, wherein said re-agitating includes re-agitating said mixture in at least two tank compartments.

4. The process defined in claim 1, wherein said second power level is reduced by increasing the volume of said another tank compartment.

5. The process defined in claim 4, wherein said re-agitating includes re-agitating said mixture in at least two tank compartments.

6. The process defined in claim 1, wherein said second power level is reduced by decreasing the horsepower of a mixer which re-agitates said mixture and increasing the volume of said another tank compartment.

7. The process defined in claim 6, wherein said re-agitating includes re-agitating said mixture in at least two tank compartments.

8. The process defined in claim 7, wherein said re-agitating further includes re-agitating said mixture at successively lower power levels as said mixture passes through said at least two tank compartments.

9. The process defined in claim 1, wherein said oxidizing agent is chlorine.

* * * * *